US005915500A

United States Patent [19]

Weaver

[11] Patent Number: 5,915,500

[45] Date of Patent: Jun. 29, 1999

[54] LIFT APPARATUS WITH TIRE ADAPTER

[76] Inventor: Derek J. Weaver, 11701 Pinecreek Ct., Aledo, Tex. 76008

[21] Appl. No.: 08/863,161

[22] Filed: May 27, 1997

[51] Int. Cl.[6] ..... B66F 7/28

[52] U.S. Cl. ..... 187/216; 187/221

[58] Field of Search ..... 187/221, 215, 187/216, 218, 219, 220; 254/89 R, 89 H; 414/785

[56] References Cited

U.S. PATENT DOCUMENTS

| | | | |
|---|---|---|---|
| 2,099,636 | 11/1937 | Weaver | 187/215 |
| 4,084,790 | 4/1978 | Molnar | 187/221 |
| 5,727,656 | 3/1998 | Gaudioso et al. | 187/221 |

*Primary Examiner*—Kenneth Noland
*Attorney, Agent, or Firm*—Geoffrey A. Mantooth

[57] ABSTRACT

The lifting apparatus can be used to lift various types of vehicles. In one embodiment, the apparatus has two posts that are spaced apart from each other. Each post has a lifting member that is capable of traversing up and down along the post. Each lifting member has two lifting arms that extend therefrom. Each lifting arm includes an inner end portion and an outer end portion. The lifting arm is pivotally coupled to the lifting member. The inner end portion and outer end portion of each lifting arm are telescopically coupled so that the lifting arm length can be extended or shortened as necessary. One version of the lifting arm has a pad at the outer end thereof, which pad contacts the vehicle chassis. Another version of the lifting arm has a tire fork adapter coupled to the outer end thereof. The tire fork adapter engages the tires of a nonroadworthy vehicle, such as turf equipment. The tire fork is provided with prongs that are located underneath the vehicle tire. The distance between the prongs can be adjusted. Furthermore, the tire fork is pivotally coupled to the lifting arm so as to allow easy placement thereof relative to the vehicle tire. The length of the lifting arm with the tire fork is short so as accommodate the shorter wheel base of nonroadworthy vehicles.

12 Claims, 4 Drawing Sheets

LIFT APPARATUS WITH TIRE ADAPTER

FIELD OF THE INVENTION

The present invention relates to apparatuses for lifting vehicles, and more particularly to two post lifting apparatuses.

BACKGROUND OF THE INVENTION

Lifts are used to access the underside of vehicles for maintenance purposes. For example, in a car or truck, the engine oil can be changed only from beneath the vehicle. It is much more convenient to raise the vehicle up so as to allow maintenance personnel to walk, rather than crawl, under the vehicle.

The vehicle is driven onto the lift. Lifting members engage the vehicle chassis. The lift is then actuated, wherein the vehicle is raised to a desirable height. Once the vehicle is positioned up off of the ground, a mechanic can then access the underside of the vehicle.

In the prior art, there are various types of lifts. One type is located in the ground. This type of lift includes a cylinder that supports the lifting members. The cylinder rises out of the ground and lowers back into the ground. This type of lift is expensive to install, as it requires excavation and other below ground work.

Another type of lift utilizes fixed vertical posts. The posts are mounted above ground, and consequently are less expensive to install than the below ground type of lift. Lifting members traverse the posts up and down to lift the vehicle. These post type of lifts come in four post or two post varieties.

Conventional four post lifts utilize four posts, with each post positioned at a comer of a rectangular area. The vehicle is driven onto ramps that are located between the posts. The ramps are raised and lowered along the posts.

Conventional two post lifts have been used in the automotive industry for some time. The two posts are spaced apart from each other. The vehicle is driven to a location between the posts. Each post has two pivotable lifting arms that move inward toward the vehicle. One lifting arm engages the front portion of the vehicle, while the other lifting arm engages the rear portion. The lifting arms can telescope to vary their length. By swinging and adjusting the length, each lifting arm can be positioned under an appropriate lifting point of the vehicle chassis.

Recently two post lifts and four post lifts have been used for turf equipment. Such turf equipment includes walk behind mowers and riding mowers. Beattie, et al., U.S. Pat. No. 5,211,264 shows one such lift. Golf courses especially use turf equipment that require frequent maintenance. For instance, mowers have reel cutters that must be cleaned and sharpened.

Such turf equipment may have 2, 3, or 4 wheels and a shortened wheel base between the front and rear axles. Raising turf equipment with a four post lift merely requires driving the turf equipment onto the ramps. The ramps may have to be repositioned in order to accommodate the distance between the wheels.

However, with a two post lift, it is difficult to position conventional lifting arms under turf equipment so that the lifting arms engage the equipment properly. In addition, many lift owners wish to use their two post lift for raising both road vehicles, such as cars and trucks, as well as turf equipment. Such dual use eliminates the need to buy two lifts, one lift for road vehicles and the other lift for turf equipment. In addition, one lift takes up less floor space than does two lifts. In fact, a two post lift takes up less floor space than a four post lift. Therefore, many lift owners prefer a two post lift over a four post lift.

The lift shown in U.S. Pat. No. 5,211,264 is not suitable for lifting road vehicles. This is because the lifting arms are designed to raise small vehicles such as turf equipment.

What is needed is a lift that can be easily adapted to raise both road vehicles and smaller vehicles such as turf equipment.

SUMMARY OF THE INVENTION

It is an object of the present invention to provide a lift apparatus that can lift both road vehicles and smaller 2, 3, and 4 wheeled vehicles such as turf equipment.

The present invention provides an apparatus for lifting a vehicle. There is at least one lifting member that is moveably coupled to a vertical support structure. The apparatus has means for raising and lowering the lifting member relative to the ground and along the vertical support structure. The lifting member is structured and arranged so as to have at least one arm that is pivotally coupled thereto. The arm is structured and arranged to contact a chassis of a vehicle. A tire fork adapter is pivotally coupled to the lifting member. The tire fork adapter replaces the arm of the lifting member. The tire fork adapter has a fork for engaging a tire of the vehicle. The tire fork adapter is extendable in length.

In accordance with one aspect of the present invention, the means for raising and lowering the lifting member relative to ground further includes a hydraulic cylinder.

In accordance with another aspect of the present invention, the lifting member has an additional arm pivotally coupled thereto. The additional arm is structured and arranged to contact the chassis of the vehicle.

In accordance with still another aspect of the present invention, the tire fork adapter includes a mounting arm and tire fork. The mounting arm is pivotally coupled to the lifting member and the tire fork is pivotally coupled to the mounting arm.

In accordance with still another aspect of the present invention, the tire fork adapter includes prongs that are structured and arranged to engage a vehicle tire. The tire fork adapter includes means for adjusting the distance between the prongs.

The present invention provides an apparatus for lifting a vehicle. The apparatus includes two vertical posts, each post having upper and lower ends. The lower end of each post is secured to ground. The posts are spaced apart from each other so as to form a driveway therebetween. There is lifting member that is coupled to each post. Each lifting member is capable of traversing between upper and lower ends of the respective post. There is a means for raising and lowering the lifting members along the respective posts. Each lifting member has an arm, which each arm having first and second ends. The first end of each arm is pivotally coupled to the respective lifting member. The arm is extendable in length. The second end of each arm has a tire fork that is coupled thereto. The tire fork is structured and arranged to engage a tire of the vehicle.

With the apparatus of the present invention, a lift can be used to raise and lower a variety of vehicles. The lift can be used for cars and trucks, as well as turf equipment such as mowers. The tire fork allows quick adaptability of the lift to raise turf equipment.

DESCRIPTION OF THE PREFERRED EMBODIMENT

Figure 1:
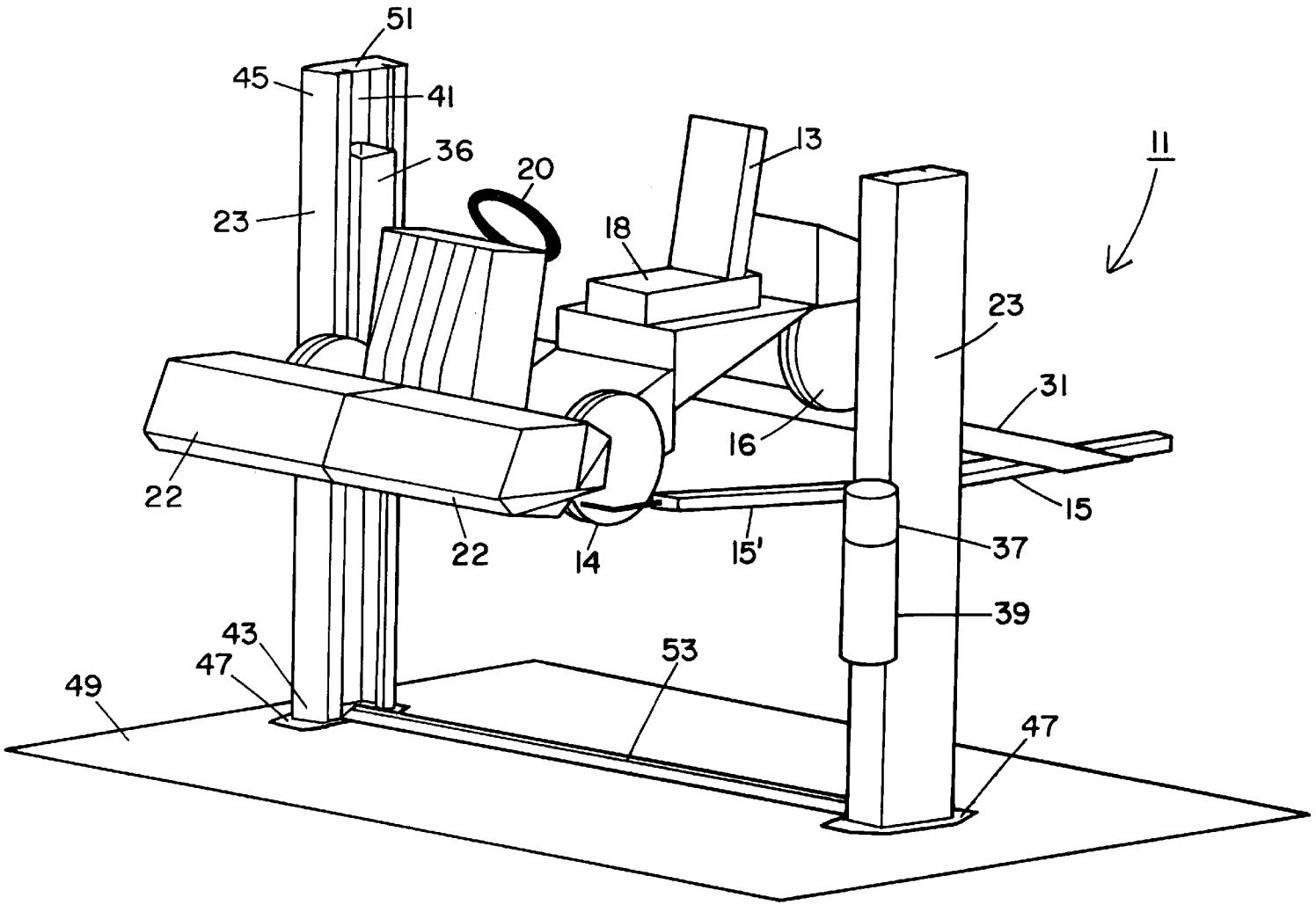
FIG. 1 is a schematic isometric view of the lift apparatus of the present invention, in accordance with a preferred embodiment, shown with a mower thereon.
Figure 2:
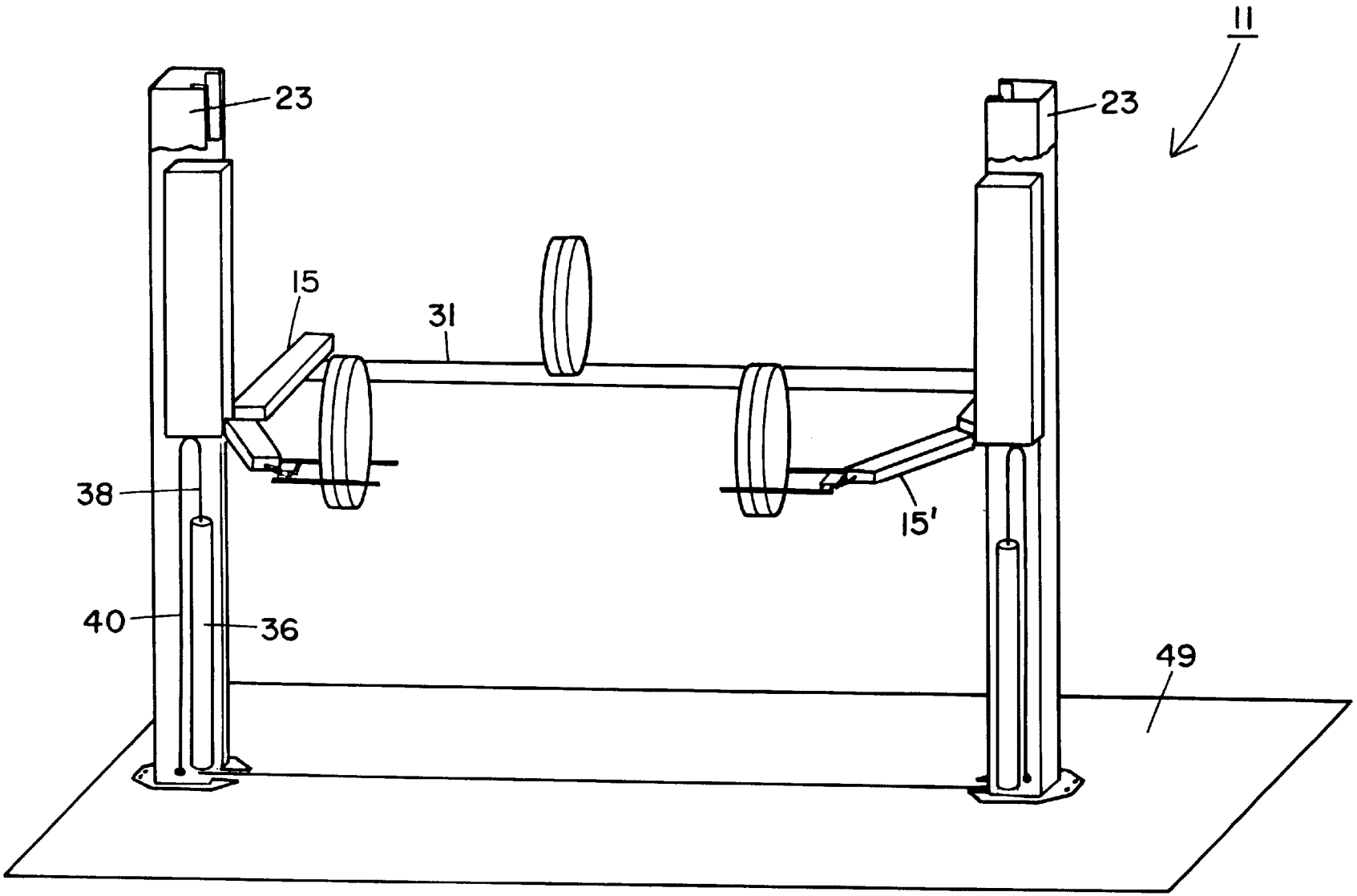
FIG. 2 is a schematic front end view of the lift apparatus, showing placement of the wheels of the mower thereon.

FIG. 1 shows the lift apparatus 11 of the present invention, in accordance with a preferred embodiment. The lift apparatus 11 of the present invention is capable of lifting both roadworthy vehicles (such as cars and trucks) and nonroadworthy vehicles (such as turf equipment, including mowers 13).

The mower 13 shown in FIG. 1 is conventional and has three tires. Specifically, there are front tires 14 and a rear tire 16. The mower 13 also has a seat 18 for the operator, a steering wheel 20 and reel cutters 22.

When the lift apparatus 11 is used for lifting the mower 13, or other similar type of vehicle, two types of lifting arms are used. Each post 23 has a rear lifting arm 15 and a front lifting arm 15'. Each lifting arm 15, 15' has an inner end portion 17 and an outer end portion 19 (see FIG. 3).

The front lifting arm 15' has a tire fork 29 for engaging the front tires 14 of the mower 13.

The mower 13 is driven into the driveway 21 between the two posts 23 of the lift. The rear tire 16 bears on a ramp 31 that in turn bears on the rear lifting arms 15. The front lifting arms 15' are swung inward so that the tire forks 29 engage the front tires 14. The mower can then be raised and lowered.

Each tire fork 29 can pivot so as to properly engage the respective vehicle tire. In addition, the distance between the prongs 33 of each tire fork can be adjusted to accommodate different sizes of tires.

When the lift apparatus is used for lifting roadworthy vehicles, the front lifting arms 15' are removed and replaced with lifting arms that are substantially similar to the rear lifting arms 15. The lift is now ready for lifting a car, truck, etc.

Figure 3:
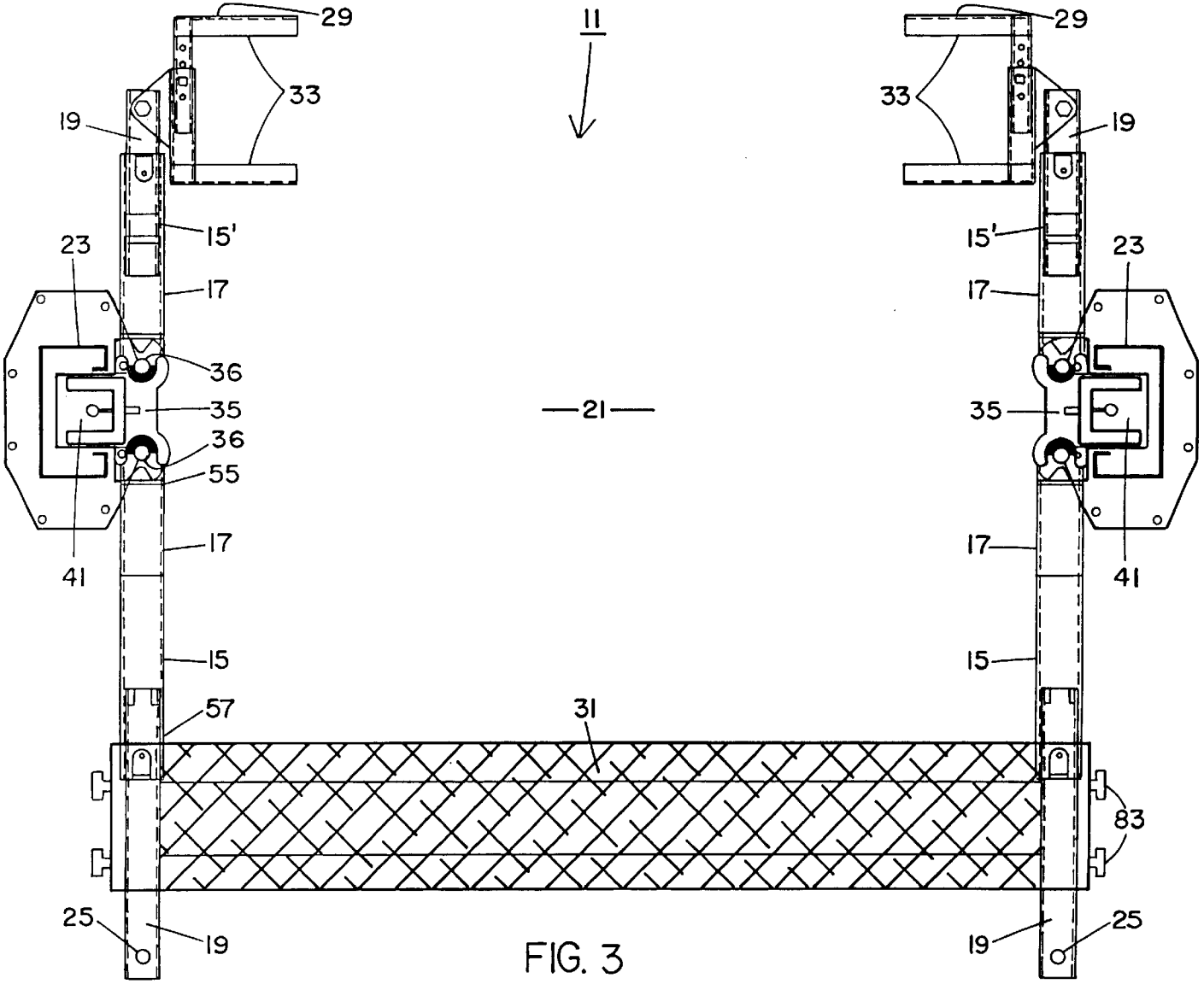
FIG. 3 is top plan view of the lift apparatus.

The specifics of the lift apparatus 11 will now be discussed. Referring to FIGS. 1 and 3, the lift apparatus 11 includes the posts 23, lifting members 35, a lifting motor or pump 37, and the lifting arms 15, 15'. The posts 23, the lifting members 35, and the lifting motor or pump 37 are conventional and commercially available. The rear lifting arms 15 are also conventional and commercially available. The front lifting arms 15', with the tire forks 29, are unique. Likewise, the combination of the various lift elements, with the tire fork, is unique.

There are two vertical posts 23. Each post 23 has a horizontal cross-section that is generally "C" shaped. Thus, there is an interior cavity 41. The posts are oriented with respect to each other such that the interior cavities 41 face each other. The posts 23 are spaced apart from each other a sufficient distance so as to form a driveway 21 between the posts. For example, the distance between the posts can be 9–10 feet. Each post 23 has a bottom end 43 and a top end 45. At the bottom end 43 of each post is mounting plate 47. The mounting plates are secured to the ground 49. The posts are typically mounted onto a concrete surface. The distance between the bottom and top ends 43, 45 of each post is sufficient to provide the desired maximum lifting height. For example, a common maximum lifting height is 72 inches. The height of the posts can be 9–10 feet.

The top ends 45 of the posts 23 need not be secured together with a cross beam. In the lift apparatus 11 shown in drawings, no cross beam is used. This allows the lift to be installed in areas having low ceilings. In addition, the absence of an upper cross beam eliminates any interference between the beam and roll bars on vehicles. Likewise, there is no cross beam, other than the ground 49, between the bottom ends of the posts. However, if desired, the lift can be provided with an upper cross beam.

The top end 45 of each post is provided with a plate 51 for reinforcement purposes and also to support a pulley (not shown). The pulley is used to guide a synchronization cable. The top end 45 of each post need not be mounted or coupled to the ceiling.

Each post 23 has a lifting member 35, or carriage, that traverses between the bottom and top ends 43, 45 of the post. Each lifting member 35 is located in the respective post interior cavity 41. The interior cavity 41 forms a guide for the lifting member, wherein the lifting member is retained in the post. Each lifting member 35 projects out away from the post, wherein the lifting arms 15, 15' are pivotably thereto.

The lifting members 35 are raised and lowered along the posts 23 by a hydraulic system. Such a hydraulic system in a two post lift is conventional and well known to those with ordinary skill in the art. An example of a hydraulic system is described in Beattie et al., U.S. Pat. No. 5,211,264, the disclosure of which is incorporated herein by reference. In the preferred embodiment, there is a hydraulic cylinder 36 in each post. The hydraulic cylinder 36 is located within the interior cavity 41. The bottom end of the hydraulic cylinder 36 bears on the plate 47. A cylinder rod 38 or ram extends out of the upper end of the hydraulic cylinder. A pulley is located at the upper end of the rod. One end of a chain 40 is coupled to the base plate. The chain traverses upward and over the pulley on the rod end. The chain then descends where it is connected to the respective lifting member or carriage. When the rod is pushed up by the hydraulic cylinder, the lifting member is likewise pushed up. When the rod descends, the lifting member descends.

An electric pump 37 and a hydraulic fluid reservoir 39 are provided on one of the posts 23. The reservoir 39 is connected to the hydraulic cylinder 36 in each post by way of hydraulic lines. There are provided hydraulic lines that extend from the post with the reservoir 39 to the post without the reservoir. These lines 53 are located along the ground. A cover plate (not shown) is provided to cover these hydraulic lines 53 and to allow vehicles to be driven over the lines.

Other power mechanisms besides hydraulic systems can be used to raise and lower and the lifting members. For example, electric motors and cables could be used.

Both lifting members 35 are raised and lowered in unison. This keeps the vehicle level as it is being moved up and down. A synchronization cable is provided between the two hydraulic cylinders. The cable traverses between the posts along side the lines 53.

Each lifting member 35 has two lifting arms 15, 15' coupled thereto. Each lifting arm 15, 15' has an inner end portion 17 and an outer end portion 19. The inner end portion 17 of each arm is pivotally coupled to the lifting member 35. For example, a pin 36 can be used to accomplish the coupling. Each lifting arm pivots or swings in a horizontal plane. When the lifting arms are positioned as shown in FIG. 3, they can be swung inward towards the driveway 21.

The inner end and outer end portions 17, 19 are telescopically coupled together so that the overall length of the arm can be adjusted. Each inner end portion 17 is provided with a stop that engages or contacts a similar stop on the corresponding outer end portion 19 when the outer end portion is fully extended. The stops prevent the outer end portion 19 from being pulled completely out of the inner end portion 17. The inner and outer end portions are rectangular tubes. Each tube is oriented so that the longer dimension of the rectangular cross-section lies in a horizontal plane, while the shorter dimension of the rectangular cross-section lies in a vertical plane.

In the rear lifting arms 15, the outer end portion has a pad 25 extending upwardly therefrom. The pad 25 is structured to contact the underside of the vehicle chassis. The height of the pad above the lifting arm can be adjusted by screwing the pad in or out from the lifting arm.

Figure 4:
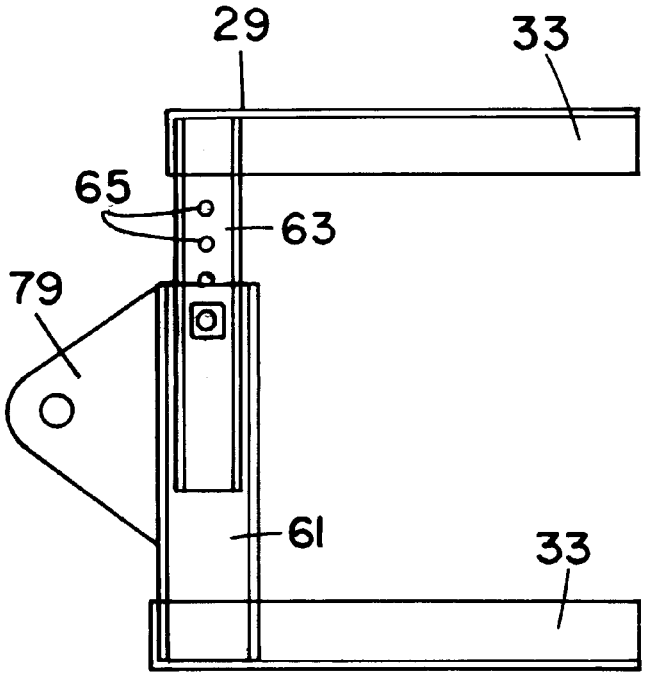
FIG. 4 is top plan close up view of one of the tire forks.
Figure 5:
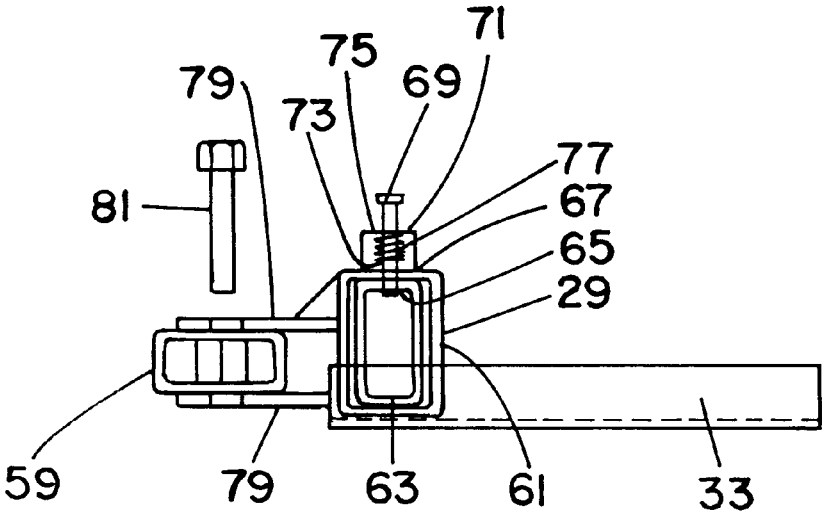
FIG. 5 is a side view of the tire fork of FIG. 4.

The outer end portion of each lifting arm is capable of having a tire fork 29 coupled thereto. Each tire fork 29 has first and second base members 61, 63 (see FIGS. 4 and 5). The second base member 63 is telescopically received by the first base member 61. A prong 33 extends from the free end of each base member 61, 63. The prongs are oriented perpendicularly to the respective base member.

Each front lifting arm 15' is shorter than the rear lifting arms 15. Turf equipment typically has a shorter wheel base than do trucks and other road vehicles. The shorter lifting arms 15' compensate for the shorter wheel base.

The first and second base members 61, 63 are both rectangular tubes. The second base member 63 is of course slightly smaller than the inside diameter of the first base member 61. The telescoping coupling arrangement between the first and second base members allows the distance between the prongs 33 to be adjusted. Thus, the tire fork 29 can be adjusted to fit different sizes of tires.

A locking mechanism is provided for locking the position of the second base member relative to the first base member. In the preferred embodiment, the second base member 63 has a line of holes 65 formed along its length. The first base member 61 has a single hole 67 formed therein. A pin 69 is inserted through the hole 67 in the first base member and through a respective one of the holes 65 in the second base member. The pin 69 is retained on the first base member by way of a bracket 71 mounted thereon. The bracket overlies the hole 67 in the first base member. The pin 69 is located in a hole in the bracket 71. The pin 69 has a shoulder 73, which shoulder is interposed between a top wall 75 of the bracket in the first base member 61. A helical spring 77 is located around the pin 69 between the shoulder 73 and the bracket top wall 75. To adjust the distance between the prongs 33, the pin 69 is pulled up out of the second base member 63. The second base member is then slid in or out of the first base member and a hole 65 in the second base member is aligned with the hole 67 in the first base member. After the adjustment between the prongs has been made, the pin 69 is released, wherein the spring 77 forces the pin into the hole in the second base member. The second base member 63 is now locked or secured to the first base member 61.

The first base member 61 has two plates 79 that extend therefrom in opposite directions from the prongs 33. The plates are spaced apart by a gap (see FIG. 5), which gap receives the free end of the mounting arm 59. A hole is formed in each plate and also in the free end of the mounting arm. A bolt or pin 81 pivotally couples the plates 79 (and the tire fork) to the free end of the mounting arm.

In operation, the lifting apparatus 11 can be configured to raise a varieties of vehicles. In FIG. 1, the lifting apparatus 11 is shown raising a mower 13.

To configure the lifting apparatus 11 for raising the mower 13, the lift is provided with front and rear lifting arms 15, 15'. If the lift 11 is configured only with lifting arms 15, then a change can be made. The lifting arms can be easily interchanged by uncoupling them from the lifting members 35. To uncouple a lifting arm, the pin 36 is removed, wherein the lifting arm 15 is removed from the lifting member 35. The new lifting arm is then put in place and the pin 36 is inserted thereby coupling the new lifting arm 15' to the lifting member 35. Thus, the two types of lifting arms 15, 15' can be easily interchanged in order to configure the lifting apparatus to lift a specific type of vehicle.

The mower is then driven into the driveway 21 between the two posts 23. The rear wheel 16 or wheels is positioned on the ramp 31 (see FIG. 1). The front wheels 14 are located close to the tire forks 29. Each fork 29 is adjusted so that the distance between the prongs 33 is less than the outside diameter of the tire. The lifting arms 15 are then swung in toward the mower so as to position the tire forks 29 beneath each tire 14.

Some vehicles may be almost as wide as the distance between the lifting members. If so, the vehicle is simply driven over the prongs 33 so as to position the tires in the tire forks. Alternatively, one of the prongs can be completely removed by lifting the pin 69. The second base member 63 is pulled completely out of the first base member 61. The vehicle tire can then be properly positioned next to the remaining prong, and the removed prong can be replaced and secured with the pin.

The vehicle 13 can now be raised. The hydraulic system raises both lifting members 35, which in turn raise the lifting arms 15, 15'. The ramp 31 raises the rear wheel 16, while the tire forks 29 raise the front wheels 14. The mower can be worked on while in the raised condition.

After work on the mower has been completed, the lifting members 35 are lowered to the ground. The mower is then driven out of the driveway 21 between the two posts.

The lift 11 is easily reconfigured for lifting a truck or other vehicle. The ramp 31 is removed and the front lifting arms 15' are replaced with the longer type of lifting arms 15. In this configuration, the front and rear lifting arms 15 are substantially similar to each other. The lift 11 is operated in accordance with conventional practice.

Although the present invention has been described in conjunction with a two post above ground lift, the invention can also be used on other types of lifts. For example, the invention can be used on a four post above ground lift, as well as an in ground lift. In addition, the tire forks 29 can be retrofitted on to existing lifts. For example, there are automotive and light truck lifts having telescoping arms that can be retrofitted with tire forks 29.

The foregoing disclosure and showings made in the drawings are merely illustrative of the principles of this invention and are not to be interpreted in a limiting sense.

I claim:

1. An apparatus for lifting a vehicle, comprising:

a) at least one lifting member moveably coupled to a vertical support structure;

b) means for raising and lowering the lifting member relative to ground and along the vertical support structure;

c) the lifting member being structured and arranged so as to have at least one arm that is pivotally coupled thereto, the arm being structured and arranged to contact a chassis of the vehicle;

d) a tire fork adapter that is pivotally coupled to the lifting member, the tire fork adapter replacing the one arm on the lifting member, the tire fork adapter having a fork for engaging a tire of the vehicle, the tire fork adapter being extendable in length.

2. The apparatus of claim 1 wherein the vertical support structure comprises a post located above the ground, and the lifting member traverses up and down along the post.

3. The apparatus of claim 1 wherein the means for raising and lowering the lifting member relative to the ground further comprises a hydraulic cylinder.

4. The apparatus of claim 1 wherein the lifting member has an additional arm pivotally coupled thereto, the additional arm being structured and arranged to contact the chassis of the vehicle.

5. The apparatus of claim 1 wherein the tire fork adapter comprising a mounting arm and a tire fork, the mounting arm being pivotally coupled to the lifting member, the tire fork being pivotally coupled to the mounting arm.

6. The apparatus of claim 5 wherein the tire fork adapter comprises prongs that are structured and arranged to engage a vehicle tire, the tire fork adapter comprising means for adjusting the distance between the prongs.

7. The apparatus of claim 1 wherein:

a) the vertical support structure comprises a post located above the ground, the lifting member traversing up and down along the post;

b) the means for raising and lowering the lifting members relative to the ground further comprise a hydraulic cylinder;

c) the lifting member has an additional arm pivotally coupled thereto, the additional arm being structured and arranged to contact the chassis of the vehicle;

d) the tire fork adapter comprises a mounting arm and a tire fork, the mounting arm being pivotally coupled to the lifting member, the tire fork being pivotally coupled to the mounting arm;

e) the tire fork adapter comprises prongs that are structured and arranged to engage a vehicle tire, the tire fork adapter comprising means for adjusting the distance between the prongs.

8. The apparatus of claim 1, further comprising:

a) a second lifting member moveably coupled to a second vertical support structure, the second vertical support structure being spaced apart from the vertical support structure so as to form a driveway therebetween;

b) a second means for raising and lowering the second lifting member relative to ground and along the second vertical support structure;

c) the second lifting member being structured and arranged so as to have at least one second arm that is pivotally coupled thereto, the second arm being structured and arranged to contact a chassis of the vehicle;

d) a second tire fork adapter that is pivotally coupled to the second lifting member, the second tire fork adapter replacing the second arm on the second lifting member, the second tire fork adapter having a second fork for engaging a tire of the vehicle, the second tire fork adapter being extendable in length.

9. An apparatus for lifting a vehicle, comprising:

a) two vertical posts, each post having upper and lower ends, with the lower end of each post being secured to ground, the posts being spaced apart from each other so as to form a driveway for the vehicle therebetween;

b) a lifting member coupled to each post, each lifting member being capable of traversing between the upper and lower ends of the respective post;

c) means for raising and lowering the lifting members along the respective posts;

d) each lifting member having an arm, each arm having first and second ends, with the first end of each arm being pivotally coupled to the respective lifting member, the arm being extendable in length;

e) the second end of each arm having a tire fork coupled thereto, the tire fork is structured and arranged to engage a tire of the vehicle;

f) each tire fork comprises two prongs, the prongs being separated from each other by a distance, each tire fork further comprises means for adjusting the distance between the respective prongs.

10. The apparatus of claim 9 wherein each of the means for adjusting the distance between the respective prongs further comprises first and second base members that are coupled together telescopically, with one of the prongs being coupled to the first base member and the other of the prongs being coupled to the second base member.

11. The apparatus of claim 10 wherein the first and second base members of each tire fork are coupled together by a pin.

12. The apparatus of claim 9 wherein:

a) each tire fork is pivotally coupled to the respective arm.

* * * * *